US006247843B1

(12) United States Patent
Buchman

(10) Patent No.: US 6,247,843 B1
(45) Date of Patent: Jun. 19, 2001

(54) RESEALABLE CLOSURE ARRANGEMENT WITH SIDE TAMPER EVIDENT STRIP FOR USE WITH A SLIDER DEVICE

(75) Inventor: James E. Buchman, Hortonville, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 0 days.

(21) Appl. No.: 09/567,614

(22) Filed: May 10, 2000

Related U.S. Application Data

(60) Provisional application No. 60/134,283, filed on May 14, 1999.

(51) Int. Cl.[7] ..... B65D 33/34

(52) U.S. Cl. ..... 383/5; 383/61; 383/64; 383/202; 383/203

(58) Field of Search ..... 383/5, 61, 64, 383/203, 202

(56) References Cited

U.S. PATENT DOCUMENTS 2,994,469 * 8/1961 Troup et al. ..... 383/64 X
5,211,482 * 5/1993 Tilman ..... 383/202
5,456,928 * 10/1995 Hustad et al. ..... 383/5 X
5,669,715 9/1997 Dobreski et al. .
5,911,508 * 6/1999 Dobreski et al. ..... 383/5
5,964,532 * 10/1999 Phillips et al. ..... 383/5

FOREIGN PATENT DOCUMENTS 0 485 741 A1 * 5/1992 (EP) ..... 383/61
0 528 721 A2 * 2/1993 (EP) ..... 383/61
WO 93/11051 * 6/1993 (WO) ..... 383/66

* cited by examiner

*Primary Examiner*—Jes F. Pascua
(74) *Attorney, Agent, or Firm*—Thomas R. Trempus

(57) ABSTRACT

A flexible package includes a recloseable zipper along the mouth of the package for selective opening and closing of the mouth. The zipper includes first and second closure profiles, which are configured and constructed to selectively interlock. A tamper evident seal is provided, attached to both the first and second closure members to indicate whether or not the seal on the package has been damaged. The tamper evident seal extends along a side of at least one of the first and second closure profiles. A slider device is configured and constructed to facilitate the mating (closing) and unmating (opening) of the zipper, and to open the tamper evident seal to provide access to the package interior.

10 Claims, 3 Drawing Sheets

RESEALABLE CLOSURE ARRANGEMENT WITH SIDE TAMPER EVIDENT STRIP FOR USE WITH A SLIDER DEVICE

This application claims the benefit of U.S. Provisional Application No. 60/134,283, filed May 14, 1999.

FIELD OF THE DISCLOSURE

The present disclosure generally relates to closure arrangements for packages. In particular, the present disclosure relates to closure arrangements having recloseable profiles and slider devices to open and close the profiles.

BACKGROUND

Many packaging applications use resealable containers to store various types of articles and materials. These packages may be used to store and ship food products, non-food consumer goods, medical supplies, waste materials, and many other articles. Slider devices have been used to help open and close closure profiles on recloseable and/or resealable bags and other packages.

Resealable packages are convenient in that they can be closed and resealed after the initial opening to preserve the enclosed contents. The need to locate a storage container for the unused portion of the products in the package is thus avoided. As such, providing products in resealable packages appreciably enhances the marketability of those products.

Some perishable goods are sold to consumers packaged in recloseable bags or other packages. For example, cheese, meat or vegetable products can be packaged in a bag with recloseable closure profiles so that after opening the package, the package can be re-closed and the freshness of the product retained. Often these packages include tamper evident features to inform the consumer whether the package previously has been opened. Because of the construction of these packages with recloseable closure profiles, it has been difficult to place a tamper evident feature on a bag or package that uses a slider device to help open and close the recloseable closure profiles.

Improvements in packaging, that includes tamper evident features and easily recloseable seals, are desirable.

SUMMARY OF THE DISCLOSURE

The present disclosure relates to a package, such as a flexible package, having a combination of a resealable, recloseable zipper closure mechanism comprising first and second engageable closure profiles and a tamper evident seal. The tamper evident seal is attached to each half of the zipper mechanism (i.e., the second closure profile and the first closure profile) and extends along the side of at least one of first and second profiles. Opening and closing of the zipper closure mechanism is accomplished by a slider device mounted on the zipper closure. The slider device facilitates mating and unmating of the first and second closure profile members of the zipper closure. The slider device includes a cutting device located on at least one of the slider device arms that slits or otherwise opens the tamper evident seal, to provide access to the interior of the package. An attempt to gain access to the interior of the package requires moving the slider device across the zipper, thereby opening the tamper evident seal, or otherwise penetrating the tamper evident seal.

In particular, this disclosure relates to a package comprising a package enclosure having at least two sides and a mouth, the mouth providing access to the package interior.

A recloseable zipper closure, having first and second closure profiles along the mouth, selectively opens and closes the mouth. Typically, the first and second closure profiles include engageable first and second closure profile members. A tamper evident seal is attached to both the first closure member and to the second closure member, so as to seal access to the package interior. The tamper evident seal extends along the side of at least one of the first and second closure members. In addition to being constructed and arranged to selectively open and close the mouth to provide access to the package interior, the slider device has a cutting device constructed and arranged to open or otherwise penetrate or breach the tamper evident seal. Upon first movement of the slider device across tamper evident seal, the seal is at least partially broken, indicating attempted access to the interior. A method of opening a package is also provided.

DETAILED DESCRIPTION

Figure 1:
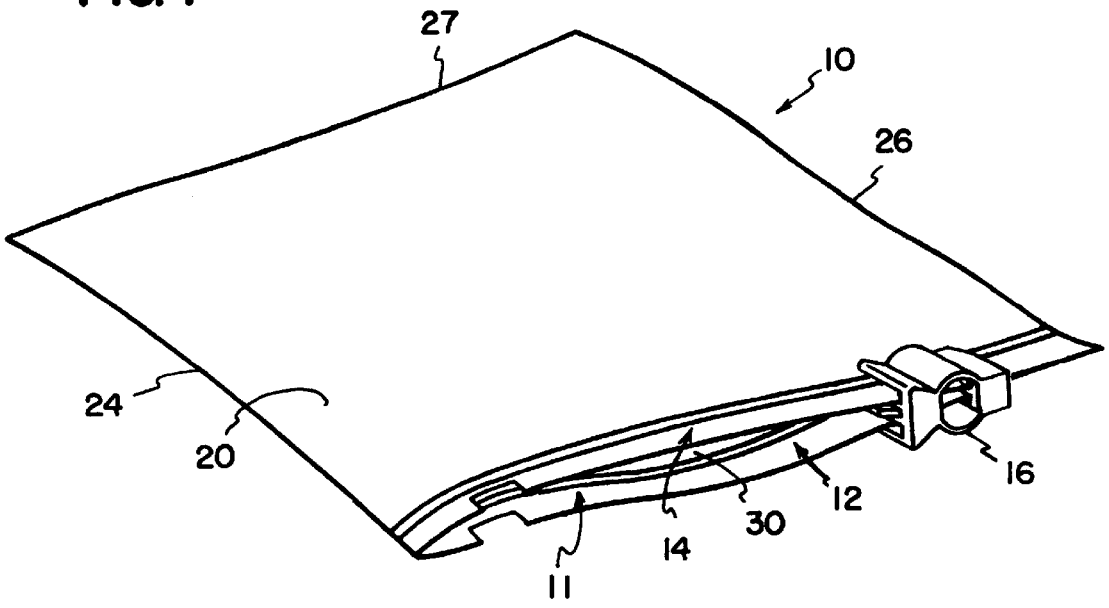
FIG. 1 is a perspective view of a flexible, recloseable package, according to the principles of this disclosure, with the zipper closure arrangement in an open position.
Figure 2:
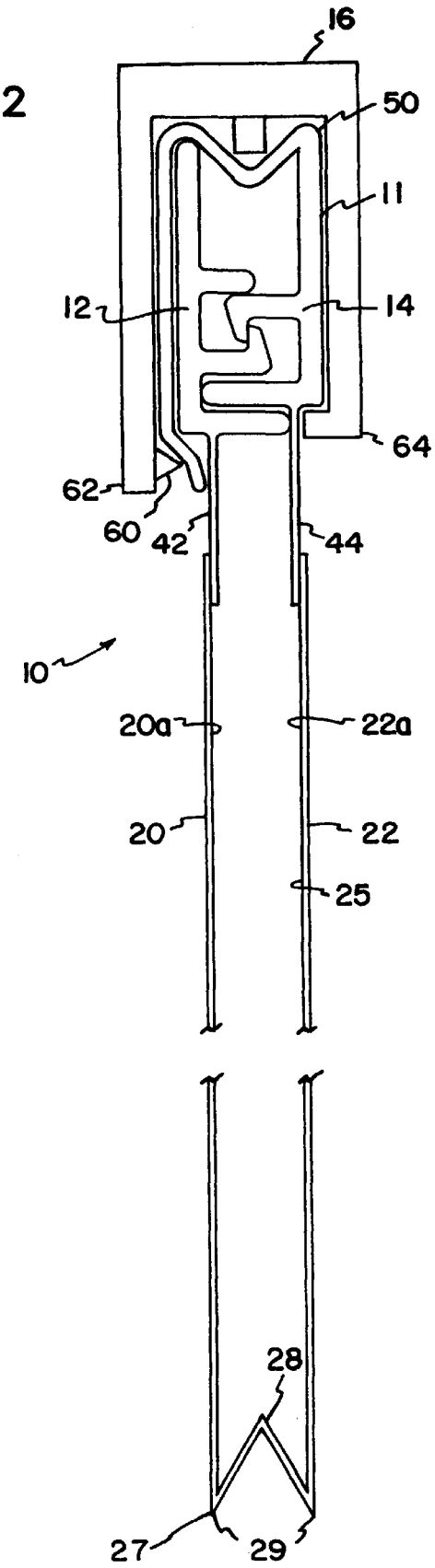
FIG. 2 is a schematic, fragmented, cross-sectional view of a flexible, recloseable package, according to the principles of this disclosure, with the closure arrangement in a closed or sealed position.

Attention is directed to FIGS. 1 and 2, which illustrate an example of a packaging arrangement in the form of a resealable, flexible package 10 having a zipper closure 11 with first and second closure profiles 12, 14 and a slider device 16 to engage and disengage the profiles 12, 14. In FIG. 1, first and second closure profiles 12, 14 are shown open, that is, not engaged; in FIG. 2, first and second closure profiles 12, 14 are mated, that is, engaged.

The flexible package 10 includes first and second opposed panel sections 20, 22 made from a flexible, polymeric film. For some manufacturing applications, the first and second panel sections 20, 22 are heat-sealed together along two edges 24, 26 (FIG. 1) and meet at a bottom edge 27 in order to form a three-edged containment section for a product within the interior 25 (FIG. 2) of the package 10. The bottom 27 of package 10 may include pleats 29, FIG. 2, to allow expansion of package 10 in width; such pleats are commonly referred to as a "gusset" or "gussets". First and second panel sections 20, 22 may meet at bottom fold 28 such as shown in FIG. 2, which, although it is not the bottom edge 27 of package 10, would be if pleats 29 were unfolded and package 10 were extended. Alternatively, two separate panel sections 20, 22 of polymeric film may be used and heat-sealed together along the two edges 24, 26 and at the bottom edge 27, or at bottom fold 28 or either pleat 29. Access is provided to the interior 25 of the package 10 through a mouth 30 (FIG. 1).

The zipper closure 11 can include a variety of configurations and structures. For example, the zipper closure 11 can be constructed according to U.S. Pat. Nos. 4,240,241; 4,246,288; or 4,437,293; each of which is incorporated by reference herein.

Figure 3:
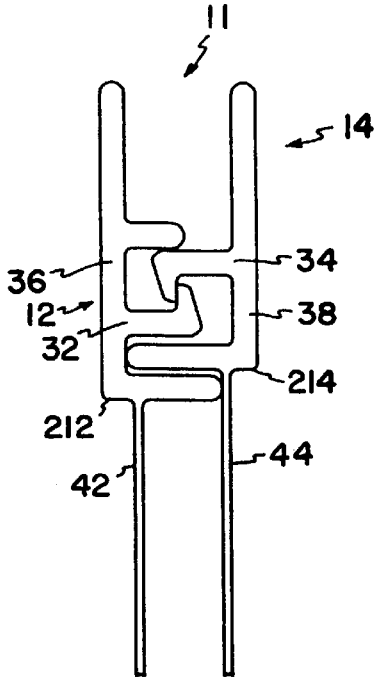
FIG. 3 is a schematic, cross-sectional view of a zipper closure arrangement having first and second engageable closure profiles.

In the particular recloseable zipper closure arrangement shown in FIG. 3, the zipper closure 11 has mating first and second closure profiles 12, 14 in the form of a first profile member 32 and second profile member 34. The first profile member 32 has a first depending fin or flange 42 extending from a first profile member element 36, and the second profile member 34 has a second depending fin or flange 44 extending from a second profile member element 38. If the zipper closure 11 is formed separately from the panel sections 20, 22, the first and second fins 42, 44 are attached, typically thermally fused, as illustrated in FIG. 2, to inner surfaces 20*a*, 22*a* of the respective first and second panel sections 20, 22. Alternatively, the zipper closure 11 may be extruded with the panel sections 20, 22 so that the first fin 42 is integrally formed with the first panel section 20, and the second fin 44 is integrally formed with the second panel section 22.

Referring again to FIGS. 1 and 2, slider device 16, mounted on zipper closure 11, opens and closes (unmates and mates) first and second closure profiles 12, 14. When slid in a first direction, slider device 16 closes profiles 12, 14 by pressing the two profiles 12, 14, in particular, first profile member 32 and second profile member 34 (illustrated in FIG. 3), together so that they engage and mesh, providing a seal. When slid in an opposite, second direction, slider device 16 opens profiles 12, 14 by providing a wedge between the two profiles 12, 14. First and second closure profiles 12, 14 can then be spread apart to provide access to the package interior 25 (FIG. 2) through package mouth 30 (FIG. 1). Slider devices and how they function to open and close zipper closures, in general, are taught, for example, in U.S. Pat. Nos. 5,063,644; 5,301,394; 5,442,837, and 5,664,229, each of which is incorporated by reference herein. A preferred slider device is taught in U.S. patent application Ser. Nos. 09/365,215 and 29/108,657, both filed Jul. 30, 1999 and incorporated herein by reference in their entirety.

A tamper evident seal is provided to evidence whether or not the recloseable package has been previously opened. By "tamper evident", it is meant that an attempt to breach the integrity of a seal is evidenced or shown by damage to, distortion or destruction of the seal. FIGS. 2, 4, 5 and 6 illustrate examples of a tamper evident seal 50, 50' sealed on first and second closure profiles 12, 14 and extending along the edge of at least one of first and second profiles 12, 14. It will be appreciated that when tamper evident seal 50, 50' is undisturbed (that is, seal 50, 50' has not been penetrated, breached or otherwise disturbed), first and second closure profiles 12, 14 cannot be spread in order to provide access to the package interior.

Figure 4:
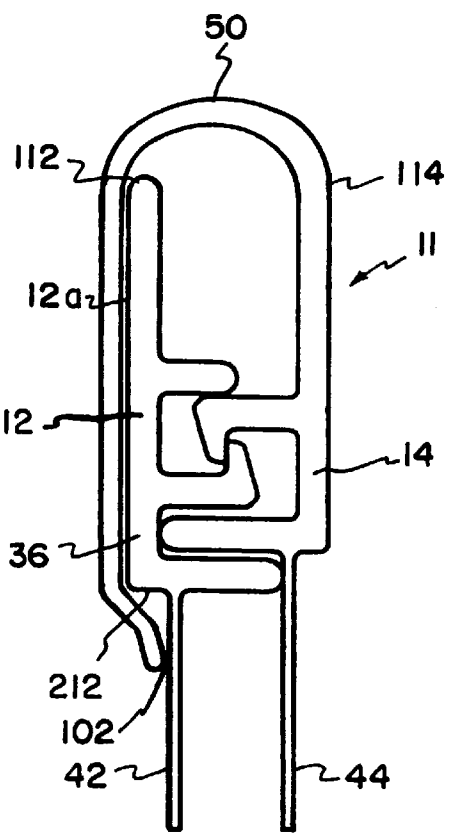
FIG. 4 is a schematic, cross-sectional view of a first embodiment of a zipper closure arrangement having a tamper evident seal, constructed according to the principles of this disclosure.

Referring to FIG. 4, tamper evident seal 50 extends from first closure profile 12 to second closure profile 14 and along the side of one of the closure profiles; in the embodiment shown in FIG. 4, tamper evident seal 50 extends along the side 12*a* of first closure profile 12. In particular, tamper evident seal 50 extends from distal end 114 of second closure profile 14 (opposite second fin 44) to distal end 112 of first closure profile 12, along the side 12*a* of first closure profile 12, and attaches to first fin 42 at a region below first profile shoulder 212. By "extending along the side" it is meant that tamper evident seal 50 is positioned either adjacent, against, next to, or the like, in relation to side 12*a* of first closure profile 12. Tamper evident seal 50 is not attached to side 12*a;* rather, tamper evident seal 50 extends along side 12*a* of first profile member element 36 and is attached at a region 102 below first profile shoulder 212. By the term "below the shoulder", it is meant that tamper evident seal 50 is attached to some portion of the package 10 at region 102 between the profile shoulder 212 of closure profile 12 and bottom edge 27 (FIGS. 1 and 2) of package 10. For example, tamper evident seal 50 can be attached to first fin 42. In another embodiment, tamper evident seal 50 is attached to first side panel 20.

Region 102, where tamper evident seal 50 is attached, extends along the length of zipper closure 11 (FIG. 1), preferably from edge 24 to edge 26 of package 10 (FIG. 1). Region 102 is positioned either closer to, or approximately the same distance, from bottom edge 27 (FIG. 2) as is slider arm 62, for reasons as will be described below.

Attachment of tamper evident seal 50 to first closure profile 12 at region 102 below shoulder 212 allows tamper evident seal 50 to be broken in any area between region 102 and distal end 114 of second closure profile 14. For example tamper evident seal 50 could be broken close to distal end 112, close to distal end 114, below shoulder 212, above shoulder 212, or anywhere along the length of tamper evident seal 50. If region 102 is positioned on side panel 20, tamper evident seal 50 can be broken close to panel 20. A break in tamper evident seal 50 between the regions of attachment to first and second profiles 12, 14, that is, between region 102 and distal end 114, will allow zipper closure 11 to be opened and access gained to the interior 25 (FIG. 2).

In some instances, it may be possible to release first closure profile 12 from second closure profile 14 (i.e., open or unzip the zipper closure 11); however, tamper evident seal 50 would remain intact and retain the security of the contents of the package 10 by not permitting package 10 to be opened and access gained to the interior 25 (FIG. 2) through mouth 30 (FIG. 1). Preferably, tamper evident seal 50 extends the entire length of zipper closure 11, which is typically the width of package 10, that is, from one edge 24 to the other edge 26 (FIG. 1).

Tamper evident seal 50 may be made from any material that can be permanently attached to closure profiles 12, 14 and that is sufficiently flexible to move with flexible package 10. Tamper evident seal 50 may be made from materials such as metal (for example, aluminum foil), paper, or cloth, but is preferably made from an extruded polymeric material, often from the same material as the first and second closure profiles 12, 14 or the side panels 20, 22 (FIGS. 1 and 2).

Tamper evident seal 50 may be attached to closure profiles 12, 14 by any method that provides a permanent adherence of tamper evident seal 50 to first and second closure profiles 12, 14. If tamper evident seal 50 is made from a polymeric material, the polymeric piece that results in tamper evident seal 50 may be formed integral with a closure profile, such as second closure profile 14 in FIG. 4, to be a continuous extension of distal end 114, such as shown in FIG. 4. To form such a continuous piece, the portion that provides tamper evident seal 50 is extruded with second closure profile 14. This piece is then folded to proper position in relation to first closure profile 12 and permanently sealed, typically thermally fused, to first profile 12 at region 102 below shoulder 212.

Figure 5:
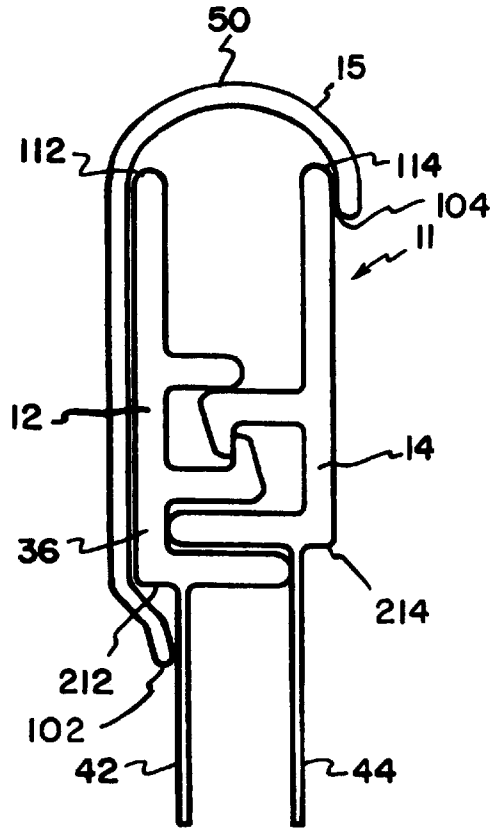
FIG. 5 is a schematic, cross-sectional view of a second embodiment of a zipper closure arrangement having a tamper evident seal, constructed according to the principles of this disclosure.

In another embodiment, illustrated in FIG. 5, a polymeric film segment, membrane or segment 15 is applied over the distal ends 112, 114 of closure profiles 12, 14, respectively, after the profiles have been formed and, optionally, attached to first and second panels 20, 22 (FIGS. 1 and 2). The polymeric segment 15 is attached to closure profiles 12, 14 to form a tamper evident seal 50, such as shown in FIG. 5. The polymeric film segment 15 that forms tamper evident seal 50 may be attached to closure profiles 12, 14 by methods such as adhesive or, preferably, be thermally fused. FIG. 5 illustrates polymeric film segment 15 attached to first closure profile 12 below shoulder 212 at region 102 and to second closure profile 14 at region 104 close to distal end 114.

In yet another embodiment, a polymeric film piece or segment can be attached to first closure profile 12 below shoulder 212 and to second closure profile 14 below shoulder 214 (FIG. 5).

Tamper evident seal 50, no matter how constructed or applied, should provide a permanent seal across the distal ends 112, 114 of first and second closure profiles 12, 14 so that any tampering, vandalism, mutilation, or the like of the zipper closure 11 is readily discernible.

Figure 6:
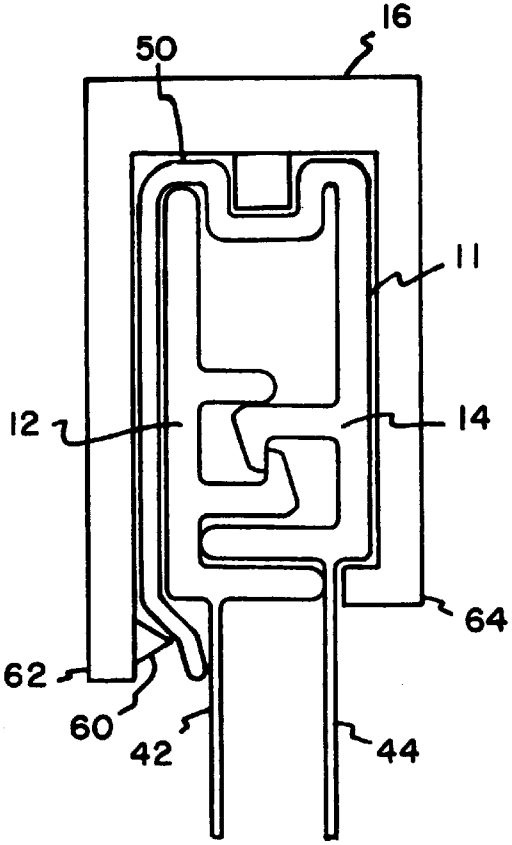
FIG. 6 is a schematic, cross-sectional view of the zipper closure arrangement depicted in FIG. 4 having a slider device mounted on the zipper closure arrangement, constructed according to the principles of this disclosure.

FIGS. 2 and 6 illustrate zipper closure 11 having tamper evident seal 50 with a slider device 16 mounted over it. Slider device 16 has a first arm 62 and a second arm 64 that respectively, engage over shoulder 212 of first closure profile 12 and shoulder 214 of second closure profile 14 (FIG. 3). Slider device 16 functions by facilitating the mating (closing) and unmating (opening) of zipper closure 11, and is typically made from a molded plastic material. When slider device 16 is slid in a first direction along zipper closure 11, slider device 16 closes profiles 12, 14 by pressing the two profiles 12, 14, in particular, first profile member 32 and second profile member 34 (illustrated in FIG. 2), together so that they mate, providing a seal. When slider device 16 is slid in the opposite second direction, slider device 16 opens profiles 12, 14 by providing a wedge between the two profiles 12, 14. First and second closure profiles 12, 14 can then be spread apart to provide access to the package interior 25 (FIG. 2) through bag mouth 30 (FIG. 1). Slider device 16, according to the principles of this invention, mounts over first and second closure profiles 12, 14 scaled by tamper evident seal 50 and, slider device 16 is constructed and arranged to open and close the profiles in the same manner as conventional slider devices.

Slider device 16, on at least one of first arm 62 and second arm 64, has a cutting device 60 for opening tamper evident seal 50. By the term "open", any action such as slitting, puncturing, cutting, slicing, perforating, and the like, which breaks, breaches, or otherwise penetrates tamper evident seal 50 and allows access to the interior 25 of the package 10 (FIG. 2), is intended. Cutting device 60 is typically a sharp edge or point adapted to easily slice through tamper evident seal 50. In some embodiments, cutting device 60 can be constructed to weaken or score tamper evident seal 50, allowing the consumer to actually break through seal 50.

Cutting device 60 is an extended or extendible, and optionally retractable, feature positioned on at least one of first arm 62 and second arm 64 that is capable of facilitating opening of tamper evident seal 50. The position of cutting device 60 on slider 16 depends on the desired position to cut tamper evident seal 50. In FIGS. 2 and 6, cutting device 60 is positioned below shoulder 212, in close proximity to where tamper evident seal 50 is attached to first closure profile 12.

Cutting device 60 may be manufactured from metal, plastic, or any other suitable material and may be permanently or removably attached to slider device 16. Preferably, cutting device 60 is molded from a plastic material. In some embodiments, cutting device 60 is molded simultaneously with slider device 16. Preferably, cutting device 60 is integrally molded with slider device 16; that is, slider device 16 and cutting device 60 are molded together as the same item or piece. If cutting device 60 is molded integral with slider device 16, cutting device 60 may be fixedly positioned on slider device 16 or, cutting device 60 may be pivotally attached to slider device 16, for example, by a living hinge.

Referring to FIGS. 2 and 6, cutting device 60 is illustrated positioned on first arm 62 of slider device 16 at a region below shoulder 212 of first closure profile 12. Cutting device 60 extends from arm 62 and contacts tamper evident seal 50 below shoulder 212. When slider device 16 is moved along zipper closure 11, cutting device 60 is likewise moved along tamper evident seal 50 and cutting device 60 opens tamper evident seal 50. Depending on the arrangement of tamper evident seal 50 and where opening of tamper evident seal 50 is desired, cutting device 60 may be positioned anywhere on slider device 16. For example, in some embodiments, tamper cutting device 60 may be positioned on first arm 62 so as to open tamper evident seal 50 at a point equally between distal end 112 and shoulder 212 of first closure profile 12. In embodiments where tamper evident seal 50 is attached to both first and second closure profiles 12, 14 at regions below their shoulders 212, 214, cutting device 60 may be positioned on either or both of first arm 62 and second arm 64.

Cutting device 60 should be designed to not damage first or second closure profiles 12, 14 and to not interfere with the opening and closing of zipper closure 11. A cutting device 60 that is removable after opening tamper evident seal 50 may be useful.

After slider device 16 and cutting device 60 have been moved so that tamper evident seal 50 has been opened, access can be gained to the interior 25 (FIG. 2) of package 10. Once opened, tamper evident seal 50 may be removed from zipper closure 11 and discarded. If cutting device 60 is removable from slider device 16, cutting device 60 may also be removed and discarded.

The above specification and examples are believed to provide a complete description of the manufacture and use of particular embodiments of the disclosure. Many embodiments of the disclosure can be made without departing from the spirit and scope of the disclosure.

Was is claimed:

1. A package comprising:

(a) a package surrounding wall having a mouth; said mouth having a length and providing access to a package interior;

(b) a recloseable zipper along said mouth for selective opening and closing of said mouth; said zipper including first and second closure profiles;

(i) said first closure profile comprising a first closure member element having a first shoulder, a first fin, and a first distal end opposite said first fin;

(ii) said second closure profile comprising a second closure member element having a second shoulder, a second fin, and a second distal end opposite said second fin;

(iii) said first and second closure members being configured and constructed to selectively interlock;

(c) a tamper evident seal attaching said first closure member to said second closure member;

(i) said tamper evident seal extending across said first distal end and said second distal end and along a side of at least one of said first closure member and said second closure member;

(ii) said tamper evident seal attached to said at least one of said first closure member and said second closure member at a region between one of said first shoulder and said first fin and said second shoulder and said second fin; and (d) a slider device configured and constructed to selectively open and close said mouth; said slider device having a cutting device operably constructed to breach said tamper evident seal.

2. A package according to claim 1, wherein said tamper evident seal extends along a side of said first closure member and is attached to said first fin.

3. A package according to claim 2, wherein said tamper evident seal is a continuous extension from said second closure profile.

4. A package according to claim 2, wherein said tamper evident seal is a segment attached to said second closure profile and extends along a side of said first closure member.

5. A package according to claim 1, wherein said tamper evident seal is a segment which extends along a side of said first closure member and along a side of said second closure member.

6. A package according to claim 1, wherein said cutting device is positioned on an arm of said slider device.

7. A package according to claim 6, wherein said cutting device is removable from said arm of said slider device.

8. A package according to claim 1, wherein said cutting device is plastic.

9. A package according to claim 8, wherein said cutting device is integrally molded with said slider device.

10. A package according to claim 1, wherein said tamper evident seal extends the length of said mouth.

* * * * *